US006199697B1

(12) United States Patent
Dirx

(10) Patent No.: US 6,199,697 B1
(45) **Date of Patent: *Mar. 13, 2001**

(54) FIXING ELEMENT FOR AN ARTICLE IN A CONTAINER

(75) Inventor: Lieven Dirx, Oud-Turnhout (BE)

(73) Assignee: Agfa-Gevaert, Mortsel (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/262,762

(22) Filed: Mar. 4, 1999

Related U.S. Application Data

(60) Provisional application No. 60/082,497, filed on Apr. 21, 1998.

(30) Foreign Application Priority Data

Mar. 23, 1998 (EP) ..... 98200903

(51) Int. Cl.[7] ..... B65D 85/48

(52) U.S. Cl. ..... 206/455; 206/449; 206/479; 206/565

(58) Field of Search ..... 206/215, 449, 206/453, 454, 455, 456, 477–481, 499, 560, 565, 784, 586

(56) References Cited

U.S. PATENT DOCUMENTS

| | | | | |
|---|---|---|---|---|
| 1,714,688 | * | 5/1929 | Mikkelsen | 206/479 |
| 2,851,787 | | 9/1958 | Gordon . | |
| 3,091,330 | | 5/1963 | Roks . | |
| 3,223,235 | * | 12/1965 | Knip | 206/449 |
| 4,874,092 | * | 10/1989 | Lara | 206/455 |
| 5,076,432 | * | 12/1991 | Wolf et al. | 206/454 |
| 5,447,234 | | 9/1995 | Faulstick et al. . | |
| 5,685,429 | | 11/1997 | Myers . | |

FOREIGN PATENT DOCUMENTS

| | | |
|---|---|---|
| 2586766 | 3/1987 | (FR) . |
| WO 9304934 | 3/1993 | (WO) . |

* cited by examiner

*Primary Examiner*—Luan K. Bui
(74) *Attorney, Agent, or Firm*—Baker Botts L.L.P.

(57) ABSTRACT

A fixing element (30) retains an article (20) from moving inside a container (10). The container (10) has a base (11) and a cover (19). The fixing element (30) has a tape portion (31) that is bent around a corner (21) of the article (20), thus retaining the corner (21) and urging the article (20) against two side walls (15, 16) of the base (11) of the container (10).

7 Claims, 5 Drawing Sheets

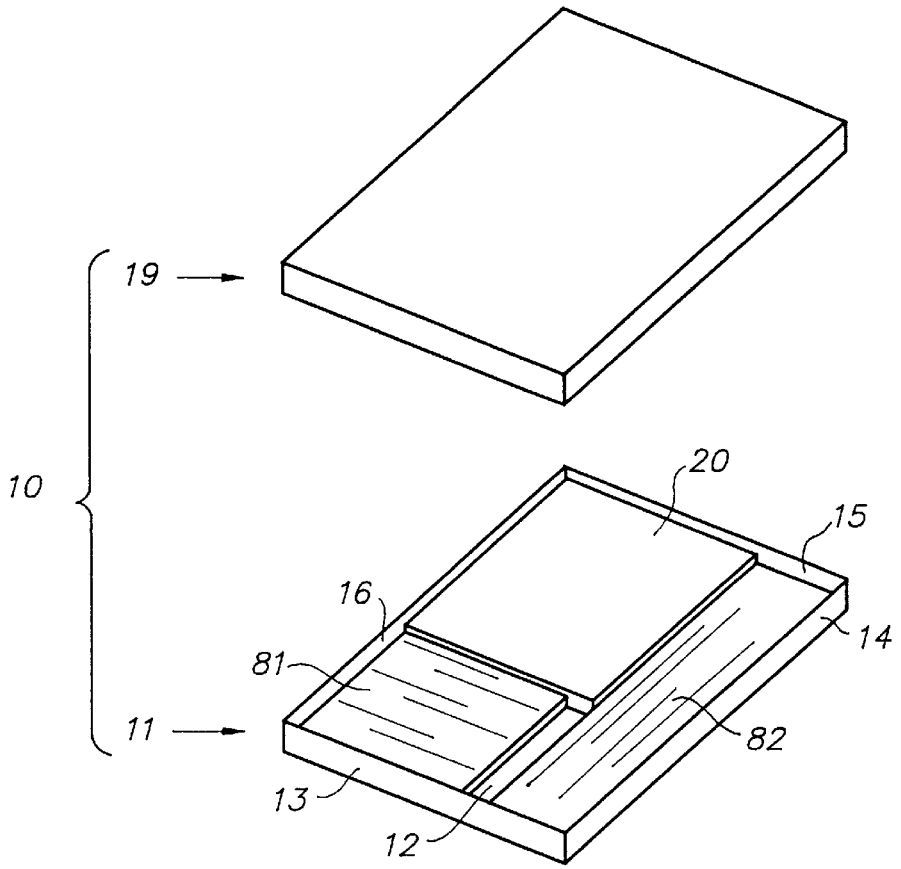
FIG. 1 --Prior Art--
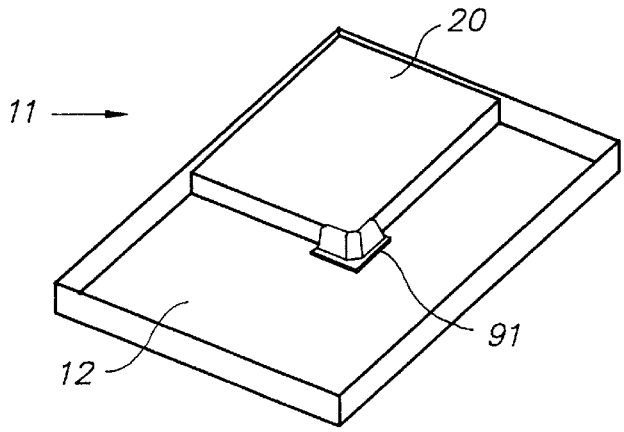
FIG. 2a
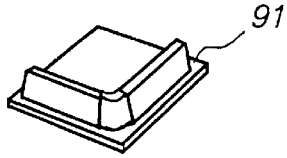
FIG. 2b
FIG. 2 --Prior Art--

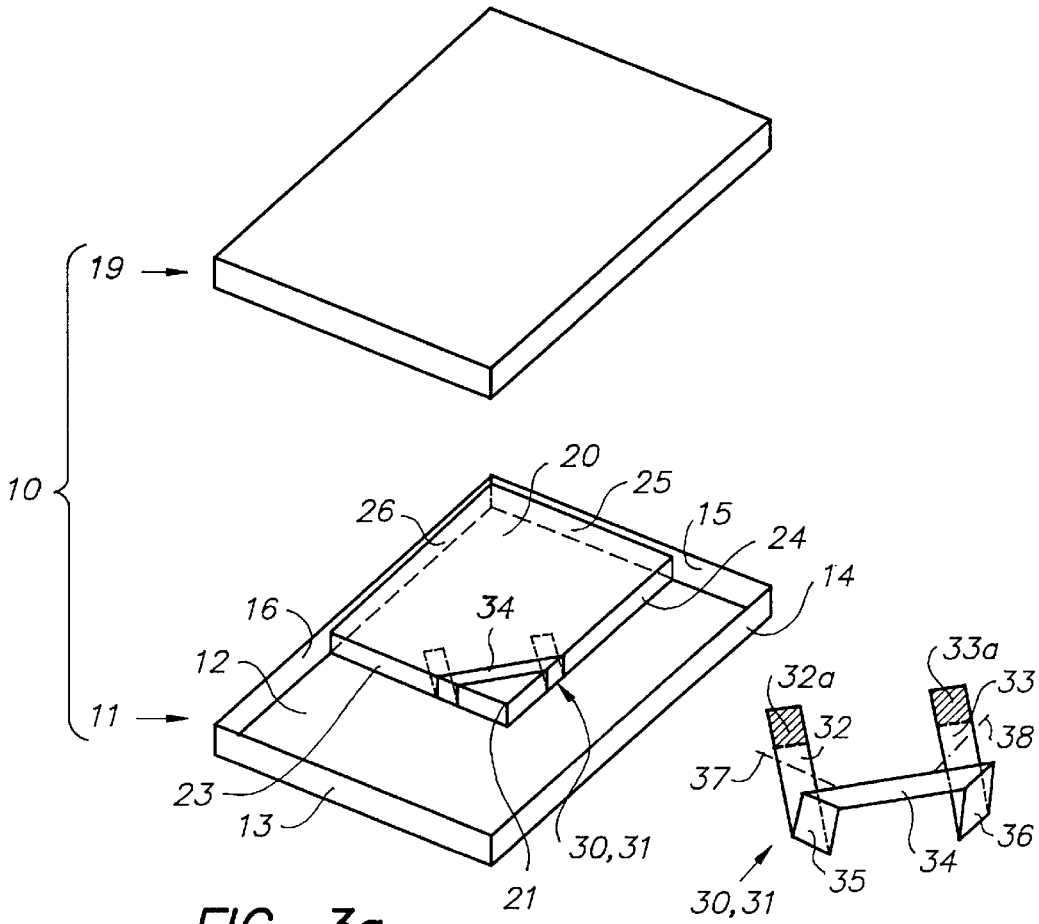
FIG. 3a
FIG. 3
FIG. 3b
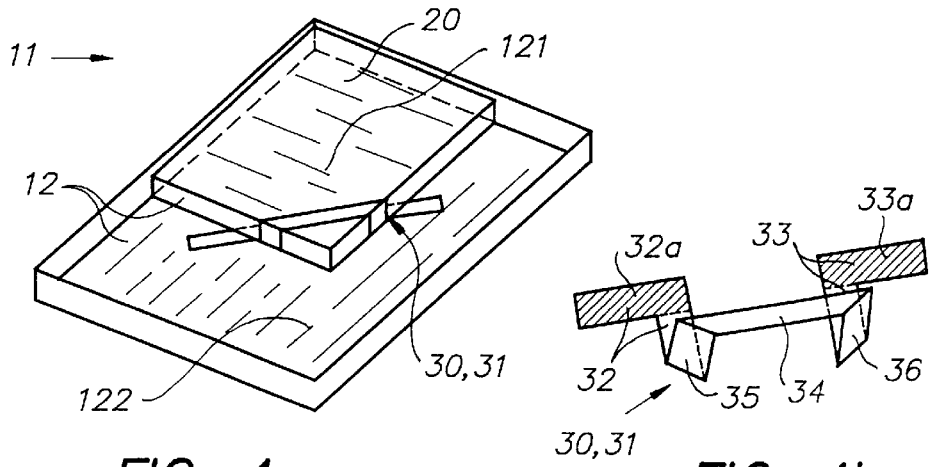
FIG. 4a
FIG. 4
FIG. 4b

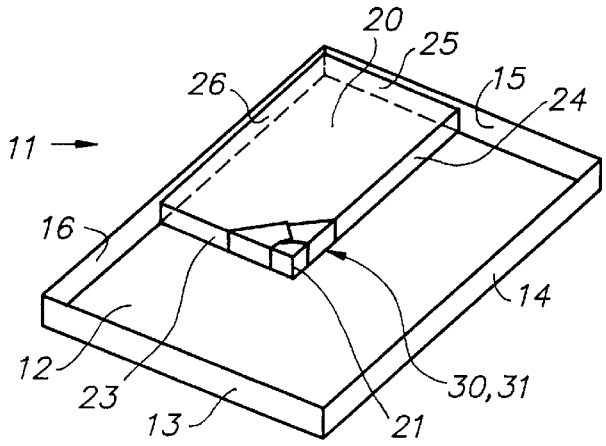
FIG. 5a
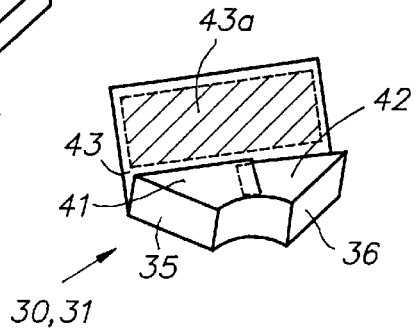
FIG. 5b
FIG. 5
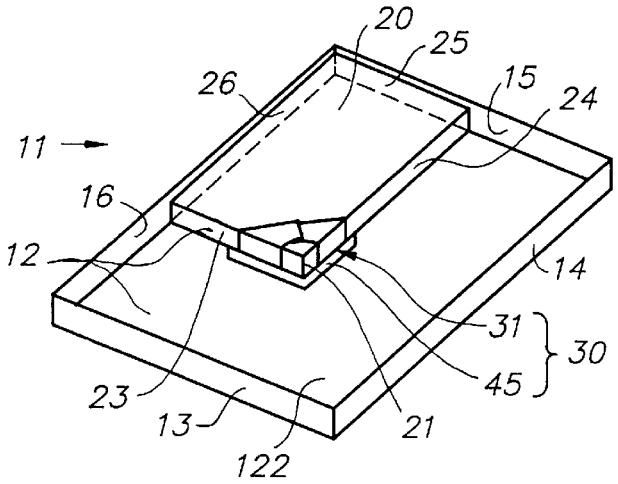
FIG. 6a
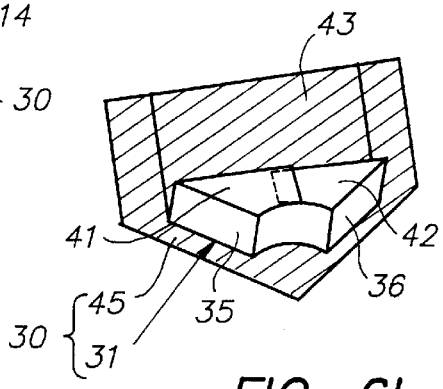
FIG. 6b
FIG. 6

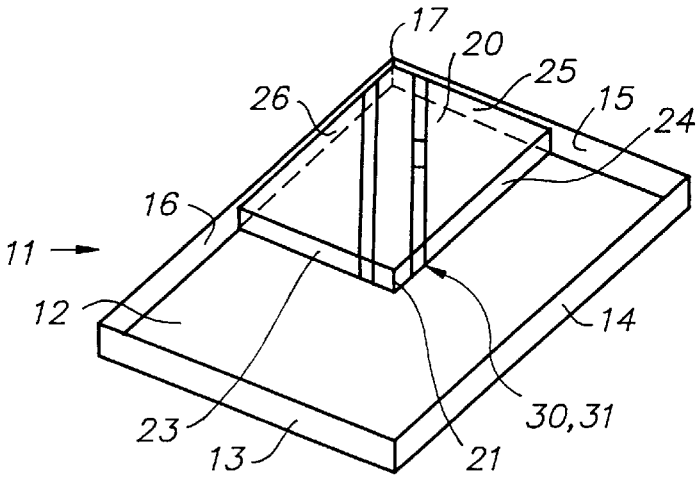
FIG. 7a
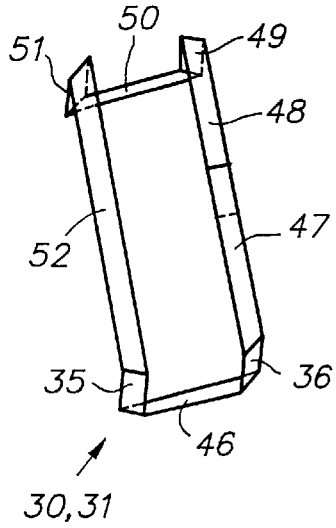
FIG. 7b
FIG. 7
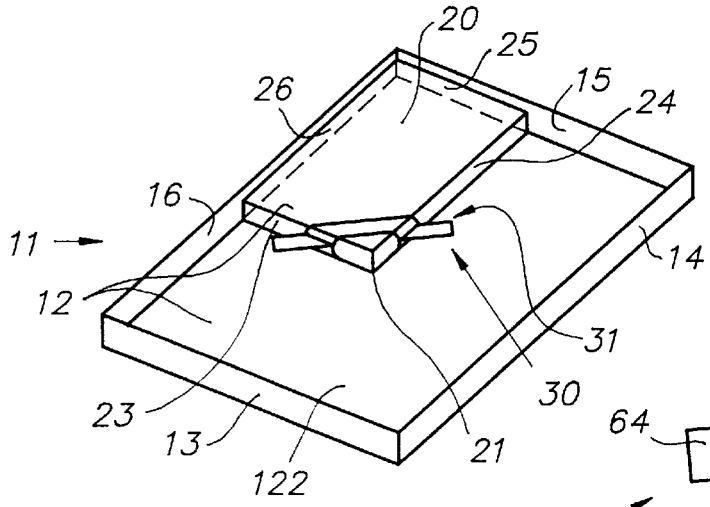
FIG. 8a
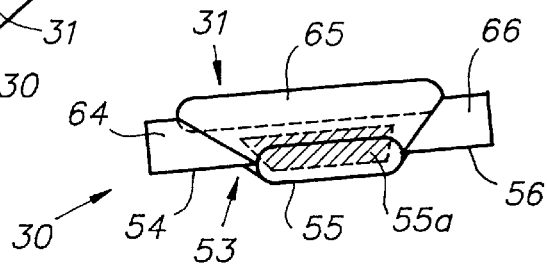
FIG. 8b
FIG. 8

FIXING ELEMENT FOR AN ARTICLE IN A CONTAINER

The application claims the benefit of the U.S. Provisional Application No. 60/082,497 filed Apr. 21, 1998.

FIELD OF THE INVENTION

The present invention relates to a container for holding a substantially flat article, that is smaller than the container. More specifically the invention relates to a rectangular flat container for holding a stack of sheets that are smaller than the container.

BACKGROUND OF THE INVENTION

When packaging an article into a container, and when the container is to be used for articles having several sizes, empty space exists between the article and the walls of the container. When shipping the container holding the article, movement of the article in the container should be restrained in order to prevent damage of the article.

In particular, when packaging a stack of sheets, especially photographic or thermographic sheets, it is customary to use a set of flat rectangular containers, having a limited number of sizes, for packaging stacks of single size sheets having many possible sizes. A container with a specific size may e.g. hold sheets of a first size, or sheets of a second size, or sheets of a third size. In this way, the required number of different packaging containers is reduced. This is especially interesting for less frequently called-for sheet sizes.

FIG. 1 shows a prior art container 10 having a base 11 and a cover 19 for the base. The base 11 has a bottom 12 and side walls 13, 14, 15, 16. To restrain movement of the stack of sheets 20 in the container 10 during handling or shipping, it is customary to fill the empty space between the sheets 20 and the side walls with strips of shock-absorbing material 81 and 82, e.g. strips of foamed polyethylene. A drawback is that the strips are cut manually, which is labour-intensive and time-consuming, and which generates dust and dirt.

Patent application EP-A-0 597 545 discloses a reusable container for packaging graphical sheet materials. The bottom of the container has channels; chocking elements can be inserted in the channels to allow sheet materials of varying sizes to be accommodated in the same container. Disadvantages are that an expensive container is required and that only those sizes of sheet materials can be accommodated for which channels are foreseen.

Patent application GB-A-2 304 332 discloses a container for film sheets, shown in FIG. 2. The container has a base 11, shown in FIG. 2*a,* and a cover for the base, not shown. The container has a chocking element 91, that is attached to the bottom 12 of the base 11, at an arbitrary location, and that restrains the film sheets 20 from moving relative to the bottom of the container. FIG. 2*b* shows the chocking element 91 more in detail. A suitable chocking element is thermoformed, and made of a high impact polystyrene having a thickness of approximately 1 mm. This container represents several disadvantages. The chocking element is rather expensive. It is difficult to remove the chocking element from the container without damaging the bottom of the container. This is a drawback if the container has to be reused for packaging sheets having a different size.

The present invention is particularly intended for packaging a stack of sheets into a container without these disadvantages; the present invention is however also applicable to packaging a substantially flat article into a container.

OBJECTS OF THE INVENTION

It is an object of the present invention to provide an improved container for holding a substantially flat article, that restrains the article from moving.

It is a further object of the invention to provide a container that is reusable and affordable.

It is another object of the present invention to provide an improved method for packaging a substantially flat article into a container, that is convenient, requires little labour and reduces packaging waste.

It is yet another object of the present invention to provide a container without the disadvantages mentioned hereinbefore.

It is still another object of the present invention to provide an improved container for holding a stack of radiation-sensitive sheets.

SUMMARY OF THE INVENTION

The above mentioned objects are realised by a container having the specific features defined in claim 1. Specific features for preferred embodiments of the invention are set out in the dependent claims.

A "substantially flat" bottom of a base is defined as follows. When a base, having a substantially flat bottom, is laid on a horizontal flat plane, the distance from any point of the lower side of the bottom to the horizontal flat plane is less than 10% of the square root of the area of the bottom. For example, a base has a rectangular bottom of 400 mm×100 mm. The bottom is substantially flat if, when laid on a horizontal flat plane, e.g. a table, all points of the lower side of the bottom are at a distance of less than 20 mm from the table ($20 = 0.1 * \sqrt{400*100}$).

A "substantially flat" article is an article having at least two substantially flat outer surfaces, the areas of these two substantially flat outer surfaces each being larger than each area of each other outer surface of the article.

Two planes are "substantially perpendicular", if the angle between the planes is between 80° and 100°.

A "tape" portion may be a simple tape, having a rectangular shape and a small thickness so that it can be wound onto a roll. A tape portion may however also have a polygonal shape—in this case it can e.g. be cut from a sheet—and the same small thickness of the simple tape referred to above.

Further advantages and embodiments of the present invention will become apparent from the following detailed description and drawings.

BRIEF DESCRIPTION OF THE DRAWINGS

The invention is described hereinafter by way of example with reference to the accompanying figures, wherein:

FIG. 1 shows a prior art embodiment of a container;

FIGS. 2*a,* 2*b* shows another prior art embodiment of a container;

FIGS. 3*a,* 3*b* shows a first embodiment of a container in accordance with the present invention;

FIGS. 4*a,* 4*b,* 5*a,* 5*b,* 6*a,* 6*b,* 7*a,* 7*b,* and 8*a,* 8*b,* respectively, show other embodiments of a container in accordance with the present invention;

DETAILED DESCRIPTION OF THE INVENTION

Figure 9:
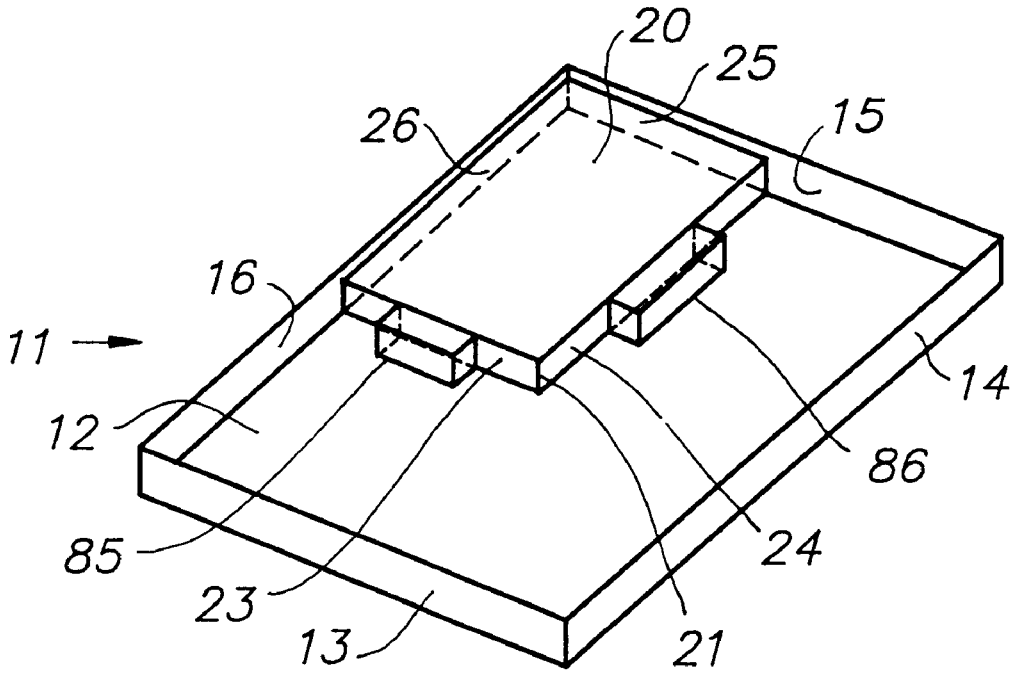
FIG. 9 shows an alternative embodiment.

FIG. 3 shows a first embodiment of a container according to the present invention. As shown in FIG. 3*a,* the container 10 has a tray-like base 11 and a cover 19 fitting onto the base. The base 11 has a bottom 12 and side walls 13, 14, 15, 16. The side walls 13, 14, 15, 16 are substantially perpendicular to the bottom 12. A stack of sheets 20 is supported by the bottom 12. Whereas in the embodiment of FIG. 6, that will be discussed hereinafter, the fixing element 30 comprises a first tape portion 31 and a second portion 45, in the embodiment shown in FIG. 3 the fixing element 30 only mainly comprises a tape portion 31. Referring to FIG. 3, the tape portion 31 of the fixing element 30 is bent around corner 21 of the stack of sheets 20 and urges the stack of sheets 20 against two side walls 15 and 16 of the base 11. FIG. 3*b* shows fixing element 30 more in detail. Bends divide the fixing element into portions 32, 35, 34, 36 and 33. The hatched portions 32*a* and 33*a* of respectively portions 32 and 33 are adhered to the bottom 12.

Movement of the stack of sheets 20 during handling or shipping is restrained as follows. The stack of sheets is supported by the bottom 12 and, if the container is turned upside-down, the stack of sheets is held by the cover 19, which is placed onto the base 11, and preferably also by the portion 34 of fixing element 30 that is bent around the corner 21 of the stack of sheets. Further, the stack of sheets cannot shift with respect to bottom 12, because it is restrained by the side walls 15 and 16 contacting the stack of sheets, and by fixing element 30. Side walls 15 and 16 exert forces on respectively sides 25 and 26 of the stack of sheets, while portions 35 and 36 of the fixing element 30 exert forces on sides 23 and 24 of the stack of sheets, i.e. the sides forming the corner 21 that is held by the fixing element 30. In this way, fixing element 30 urges the stack of sheets 20 against side walls 15 and 16 of the base 11.

FIG. 4 shows a second embodiment according to the present invention, very similar to the embodiment shown in FIG. 3. FIG. 4*a* shows the base 11 of the container; the cover is not shown. FIG. 4*b* shows fixing element 30 more in detail. In this second embodiment, two portions of bottom 12 are indicated: the portion 121 of the bottom 12 that is covered by the article 20, and the portion 122 of the bottom 12 that is not covered by the article 20. Whereas in the embodiment of FIG. 3 the fixing element 30 is only adhered to portion 121 of the bottom, in the embodiment shown in FIG. 4 the fixing element is adhered to portion 121 and to portion 122.

An advantage of this second embodiment is that at least part of the adhered portions 32*a* and 33*a* of the fixing element can be pressed directly to the bottom 12 after the article 20 is put onto bottom 12, without having to press on article 20. Portions 32*a* and 33*a* are e.g. fixed to bottom 12 by means of glue. By directly pressing portions 32*a* and 33*a* to the bottom 12, good adherence to the bottom is guaranteed.

In another embodiment, not shown in the drawings, the fixing element 30 is also adhered to portion 122 of bottom 12. First, the fixing element 30 is bent as shown in FIG. 3*b*, forming portions 32 and 33, 35 and 36, and 34. Then, portion 32 is bent along line 37, thus partly overlapping itself and extending substantially parallel to portion 34. Finally, portion 33 is bent along line 38, thus partly overlapping itself and extending substantially parallel to portion 34.

FIG. 5 shows yet another embodiment in accordance with the present invention. The base 11 of the container is shown in FIG. 5*a;* the cover is not shown. FIG. 5*b* shows the fixing element 30 more in detail. The fixing element 30 is bent around corner 21, thus forming portions 43, 35, 36, 41 and 42. Portion 43 contacts the bottom 12 of the base and the bottom side of the stack of sheets, lying on bottom 12. Portion 43*a* of portion 43 is adhered to the bottom 12. Portions 35 and 36 contact respectively sides 23 and 24 of the stack of sheets 20. Portions 41 and 42 are bent over the stack of sheets and are adhered to each other, thus retaining corner 21 of the stack of sheets. In the same way as explained hereinbefore, fixing element 30 urges the stack of sheets 20 against side walls 15 and 16 of the base 11.

FIG. 6 shows another embodiment according to the present invention, very similar to the embodiment shown in FIG. 5. In the embodiment shown in FIG. 6, the fixing element 30 comprises a first tape portion 31 and a second portion 45. The first portion 31 is bent around corner 21, thus restraining the stack of sheets 20 from moving, as in the embodiment shown in FIG. 5. The second portion 45 of the fixing element 30 is adhered to the bottom 12 of the base. Portion 31 is adhered to portion 45. Portion 45 is adhered, at least partly, to the portion 122 of the bottom 12 that is not covered by the article 20, thus offering the advantage that the fixing element can be pressed directly to the bottom 12, which guarantees good adherence to the bottom, as explained hereinbefore.

In a preferred embodiment, portion 45 is tape. In another embodiment, portion 45 has a thickness between 0.5 mm and 2 mm.

FIG. 7 shows a preferred embodiment of the present invention, wherein the fixing element is secured around a corner 17 of the base 11. FIG. 7*a* shows the base 11 of the container; the cover is not shown. FIG. 7*b* is a detailed view of the fixing element 30. The fixing element has the form of an endless belt that is bent around corner 21 of the stack of sheets 20 and around corner 17 of the base 11, thus forming portions 35, 46, 36, and 47 to 52; preferably portions 47 and 48 are adhered to each other.

A detailed description of the portions follows: portions 35 and 36 respectively contact sides 23 and 24 of the stack of sheets; portion 46 is bent under the stack of sheets and contacts the bottom 12 of the base; portions 47, 48, and 52 are bent over the stack of sheets; portions 49 and 51 contact the outer sides of the side walls 15 and 16 of the base 11, i.e. the sides contacting the cover of the container; portion 50 is bent under the base 11 of the container.

Again, the forces exerted by the fixing element 30 onto the stack of sheets 20 retain the corner 21 and urge the stack of sheets 20 against side walls 15 and 16 of the base 11.

Preferably the fixing element 30 is not adhered to the base 11. However, in another embodiment, portion 46 of the fixing element may be adhered to the bottom 12 of the base.

Preferably, the portions of the fixing element 30 that are adhered to each other, i.e. portions 47 and 48 in the embodiment shown in FIG. 7, are bent over the stack of sheets; however, these two portions may also be located elsewhere. In another embodiment, the portions that are adhered to each other are bent under the base 11 of the container.

Preferably, as shown in FIG. 7, the portion 46 of the fixing element 30 is bent under the corner 21 of the stack of sheets 20 in order to retain the stack of sheets. In another embodiment, not shown, portion 46 is bent over corner 21, portions 47, 48 and 52 contact the bottom 12 of the base, and two additional portions of the fixing element contact respectively the side walls 15 and 16 of base 11, so that the fixing element 30 passes from under the stack of sheets 20 over the side walls 15 and 16.

FIG. 8 shows another embodiment: according to the present invention. FIG. 8*a* shows the base 11 of the container; the cover is not shown. FIG. 8*b* is a detailed view of the fixing element 30. The fixing element 30 comprises two tape portions: a first portion 31 that is bent around the corner 21 of the stack of sheets, and a second portion 53 that is adhered to portion 31 and to the bottom 12 of the base.

A detailed description of the portions follows. Portion 31 comprises portions 64, 65 and 66: portion 65 is bent around corner 21, while portions 64 and 66 are adhered to respectively portions 54 and 56 of the second portion 53 of the fixing element. The second portion 53 further comprises portion 55, that contacts the bottom 12 of the base and the bottom side of the stack of sheets, lying on bottom 12. Portion 55 comprises portion 55*a* that is adhered to the bottom 12 of the base.

Preferably, the two portions 31 and 53 of the fixing element 30 are made of a heat-sealable plastic such as polyethylene, and the two portions are adhered to each other by welding. However, other adhering methods may also be used, such as gluing.

The fixing element 30 urges the stack of sheets 20 against the side walls 15 and 16 of the base 11, and retains the corner 21 of the stack of sheets.

In another embodiment, similar to the embodiment shown in FIG. 8, the portions 54 and 56 are adhered, at least partly, to the bottom 12 of the base.

To package a stack of sheets 20 into a container 10 according to the present invention, one proceeds as follows (see FIG. 7). First, the stack of sheets 20 is laid onto the bottom 12 of the base 11. Then, the stack of sheets 20 is urged against the side walls 15 and 16. Next, for the embodiment shown in FIG. 7, the fixing element 30 is bent around the corner 21 of the stack of sheets 20 and around the corner 17 of the base 11. The fixing element 30, now forming an open belt, is tensioned so that the stack of sheets 20 is urged against the side walls 15, 16 of the base 11. Portion 47 is adhered to portion 48, so that the fixing element 30 gets the form of an endless belt. Finally, the cover 19 is put onto the base 11. If desired, the cover 19 may be adhered to the base 11, e.g. by means of adhesive tape.

Alternatively, portion 47 may be adhered to portion 48 of the fixing element 30 first; then the stack of sheets 20 is laid onto the bottom 12 of the base 11. Subsequently, the corner 21 of the stack of sheets 20 is lifted and possibly bent to accommodate the fixing element 30. The other packaging steps are as described above.

For the embodiments shown in FIGS. 3–6 and FIG. 8, after the stack of sheets 20 is urged against the side walls 15 and 16 (see FIG. 3), the tape portion 31 of the fixing element 30 is bent around the corner 21, and the fixing element 30 is adhered to the bottom 11 of the base 12. Finally, the cover 19 is put onto the base 11.

For the embodiment shown in FIG. 3, preferably, as a first step in packaging, a gauge (or sizing element) is used to determine the proper position on the bottom 12 for the fixing element 30. Then, the fixing element 30 is adhered to the bottom 12, while the adhered portion(s) of the fixing element 30 are preferably pressed directly to the bottom. As mentioned hereinbefore, this practice guarantees good adherence of the fixing element to the bottom. Then, the stack of sheets 20 is laid onto the bottom 12, corner 21 of the stack of sheets 20 is slid under portion 34 of the fixing element 30, and sides 25 and 26 of the stack of sheets 20 are put against respectively side walls 15 and 16 of the base 11.

Generally, for an embodiment wherein the fixing element 30 is adhered to the bottom 12, use of a gauge is preferred. If however, as shown e.g. in FIG. 4, the fixing element 30 is adhered to the portion 122 of the bottom 12 that is not covered by the article 20, a gauge may not be required, because at least part of the adhered portion(s) of the fixing element 30 can be pressed directly to the bottom, even when the stack of sheets 20 is already lying on the bottom 12.

For an embodiment as the one shown in FIG. 6, wherein the fixing element 30 comprises at least two portions (portions 31 and 45 in FIG. 6), the two portions are preferably adhered to each other before the stack of sheets 20 is packaged into the container.

In the embodiment shown in FIG. 6, preferably portions 41 and 42 are adhered to each other before the stack of sheets 20 is packaged into the container.

For the embodiment shown in FIG. 5, several packaging methods exist.

In a first method, the fixing element 30 is completely bent as shown in FIG. 5*b* and portions 41 and 42 are adhered to each other before packaging of the stack of sheets is started. Then, the fixing element 30 is slid over the corner 21 of the stack of sheets 20, and the stack of sheets is laid onto the bottom 12 of the base 11, with the sides 25 and 26 of the stack of sheets urged against respectively the side walls 15 and 16 of the base 11. Next, the corner 21 of the stack of sheets and the fixing element 30 are pressed against the bottom 12, thus adhering the fixing element to the bottom.

A second method is similar to the first method, but after the fixing element is pressed against the bottom, the stack of sheets is temporarily removed from the bottom. The stack of sheets is lifted partly, the corner 21 remaining in its place. Then, the stack of sheets is slid, at least partly, over the side walls 15 and 16, so that the adhered portion 43*a* of the fixing element can be pressed directly to the bottom 12 of the base. Finally, the stack of sheets is put back into its place, shown in FIG. 5*a*.

A third method is similar to the second method, but here a gauge (or sizing element) is used until the fixing element 30 is directly pressed onto the bottom 12. Only then, the stack of sheets 20 is put into its place.

In a fourth method (see FIG. 5*b*) the portions 41 and 42 are not adhered to each other when starting packaging. The portions 35, 36, 41 and 42 may already be bent, or not. First, the fixing element is put against the corner 21 of the stack of sheets 20, and the stack of sheets is laid onto the bottom 12, urged against the side walls 15 and 16. Then, the corner 21 is lifted, and the adhered portion 43*a* of the fixing element 30 is pressed directly to the bottom 12. The corner 21 is lowered, and portions 41 and 42 of the fixing element 30 are adhered to each other, retaining the corner 21 and while urging the stack of sheets against the side walls 15 and 16.

After the above discussion of packaging methods, packaging a stack of sheets is now self-explanatory for the embodiments shown in FIG. 4 and FIG. 8, and for the embodiments discussed hereinbefore but not shown in the drawings.

Packaging is preferably done manually, although automation is possible too.

Adhering a portion of the fixing element to another portion or to the bottom 12 of the base can be done by gluing, by means of adhesive tape, by means of double-coated adhesive tape (possibly protected by a foil that is removed immediately before use), or by other means known in the art.

To unpack a stack of sheets 20 out of a container 10, the cover 19 is removed from the base 11. Then, the stack of sheets is lifted from the bottom 12 of the base 11 and removed; for some embodiments, the tape portion 31 of the fixing element 30 may be cut, e.g. with a knife or with scissors, to make removal easier.

Reuse of a container according to the preferred embodiments of the invention is easy. If the fixing element is not adhered to the bottom 12 of the base, as in the embodiment shown in FIG. 7, the fixing element is simply removed. In case the fixing element is adhered to the bottom 12, the old fixing element can be pressed against the bottom, since the old fixing element 30 consists of thin, tape portions, and thus a new stack of sheets may be laid onto the old fixing element, while another, new fixing element may be applied for the new stack of sheets. If desired, the tape portion 31 of the old fixing element 30 can be cut or can be partially removed by cutting; this can be useful in case of an embodiment as shown in FIG. 8, in order to press the old fixing element flat against the bottom 12.

Having described in detail preferred embodiments of the present invention, it is clear to those skilled in the art that numerous modifications can be made therein. For example, the fixing element 30 of the embodiments shown in FIGS. 3, 4, 7 and 8 may also comprise an extra portion that is adhered to the bottom 12, just as the fixing element 30 of the embodiment shown in FIG. 6 comprises an extra portion 45 with respect to the fixing element of the embodiment shown in FIG. 5.

An important feature of the present invention is that the fixing element 30 comprises a tape portion 31 that is bent around a corner 21 of the stack of sheets 20. In this way, the corner 21 is retained. Moreover, the stack of sheets is urged against two side walls 15, 16 of the base 11. The forces, exerted by the fixing element 30 onto the stack of sheets 20, have a first component (see e.g. FIG. 3: the force caused by portion 35) urging the stack of sheets against the first side wall 15, and a second component (see e.g. FIG. 3: the force caused by portion 36) urging the stack of sheets against the second side wall 16 of the base. In this way, the article in the container is restrained from moving.

The tape portion 31 preferably comprises a plastic, e.g. polyethylene or, preferably, poly(ethylene terephtalate), and preferably has a thickness between 0.02 and 0.4 mm, more preferably between 0.05 and 0.25 mm, so that it can be bent manually around the corner 21 of the stack of sheets 20.

In the embodiments of the present invention described hereinbefore, a stack of sheets 20 is packaged into the container 10. However, it is clear to those skilled in the art that the present invention is not limited to a stack of sheets. The present invention is suitable for packaging an article 20 into a container 10, if the article fulfils the following requirements. The article should be substantially flat, so that it is adequately supported by the bottom 12 of the base 11. It should have a corner 21, since this corner is to be retained by the fixing element 30.

The present invention is especially suitable for packaging a stack of sheets into a container. The sheets may comprise photographic film, thermographic sheets, polyester printing plates, paper sheets, a photographic material on a paper, cellulose triacetate, polyester, aluminium foil or glass base, or the like. The sheets can be directly stacked onto each other, but they can also remain separated from each other by interleaving foils. The sheets may be packed into a pouch, made e.g. of black-pigmented low-density polyethylene, so that the sheets are packaged dust-free and, if desired, light-tight. In another embodiment, the pouch is made of black-pigmented high-density polyethylene.

The container 11 has a cover and a tray-like base, the base having a substantially flat bottom, for supporting the article, and side walls substantially perpendicular to the bottom. In a preferred embodiment, the container has a cuboidal shape and is made of cardboard. However, the container can also be made of another material, such as plastic. The container may also have another shape: the bottom 12 of the base 11 of the container can e.g. have a trapezoidal shape, the article 20 can have five sides instead of the four sides 23, 24, 25 and 26 mentioned in the described embodiments, etc. What is required is that the base 11 of the container has at least two side walls, so that the article 20 can be urged against these side walls by the fixing element 30. As explained above, in the statement of an important feature of the present invention, in this way the article 20 is restrained from moving in the container.

A container according to the present invention has several advantages.

The container is affordable. The fixing element comprises a tape portion, which is cheaper than e.g. a—prior art—thermoformed element. Moreover, a customary base and cover can be used for the container.

All sheet sizes, smaller than the size of the bottom of the base of the container, can be packaged.

Packaging is convenient and requires little labour, compared to the customary method of using manually cut strips of shock-absorbing material. No dust and dirt are generated, which is especially important when packaging photographic material and the like.

Because the fixing element is thin, packaging waste is reduced.

The container can easily be reused.

The container can be used for packaging pressure-sensitive sheets, because the fixing element is very thin. On the contrary, when using a—prior art—thermoformed chocking element having a thickness of approximately 1 mm, the sheet corner contacting the chocking element is lying partly on the bottom of the container and partly on the chocking element. Hence, due to the thickness of the chocking element, this corner of the sheets is not lying flat. When the sheets are pressure-sensitive, this may result in damage to the sheets.

Some alternative embodiments of a container for holding a stack of sheets are described below. In all described embodiments, the container has a tray-like base and a cover; the base has a substantially flat bottom and sidewalls, that are substantially perpendicular to the bottom.

FIG. 9 shows a container that is similar to the prior art container of FIG. 1. The container has a base 11, shown in FIG. 9, and a cover, not shown. The base 11 has a bottom 12 and side walls 13, 14, 15, 16. Two small strips 85 and 86 of shock-absorbing material, e.g. strips of foamed polyethylene, are adhered to the bottom 12, contacting respectively sides 23 and 24 of the stack of sheets, so that the stack of sheets 20 is urged against the side walls 15 and 16 of the base.

In another embodiment, similar to the one of FIG. 9 and not shown, the two small strips 85 and 86 are replaced by a single, L-shaped piece of shock-absorbing material, e.g. of foamed polyethylene, adhered to the bottom 12. The L-shaped piece contacts corner 21 and sides 23 and 24 of the stack of sheets 20 and urges the stack of sheets against side walls 15 and 16 of the base.

The L-shaped piece, and the small strips 85 and 86 of the embodiment of FIG. 9, may also be made of another material, e.g. of hard plastic. Since the stack of sheets 20 is urged against the side walls 15 and 16, the stack of sheets cannot move, and hence a shock-absorbing material is not really required to prevent damage to the stack of sheets during shipping of the container.

In yet another embodiment, not shown, the stack of sheets is put between two substantially flat pieces of corrugated cardboard, each comprising a layer of anti-skid material. The first piece of corrugated cardboard contacts the bottom of the base, while its layer of anti-skid material contacts the bottom of the stack of sheets. The second piece of corrugated cardboard contacts the cover of the container, while its layer of anti-skid material contacts the top of the stack of sheets. Because of the anti-skid material, the stack of sheets cannot move inside the container, or can hardly move—and hence moves slowly, without causing damage. Instead of two pieces of corrugated cardboard, a single piece may suffice, contacting either the cover or the base.

In another embodiment, not shown, a pouch comprising a stack of sheets is adhered to the bottom of the base of the container by means of differentially adhesive, double-coated tape. The adhesion force of the pouch to the tape is smaller than the adhesion force of the tape to the bottom of the base, so that the pouch can be removed manually from the container, by tearing it from the bottom of the base.

Various combinations of different embodiments may be envisaged, such as container comprising a fixing element 30 according to FIGS. 3–8 and having at least one anti-skid surface for contacting the article 20.

Parts list

10 container
11 base
12 bottom of base
13–16: side walls of base
17 corner of base
19 cover
20 article
21 corner of article
23–26: sides of article
30 fixing element
31–36: portions of fixing element
32*a*–33*a:* portions of fixing element
37, 38: line
41–43: portions of fixing element
43*a,* 55*a:* portions of fixing element
45–56: portions of fixing element
64–66: portions of fixing element
81, 82: strip
85, 86: strip
91 chocking element
121, 122: part of bottom

What is claimed is:

1. A combination of a container and a substantially flat article having a first corner, the container comprising:

a tray base having a substantially flat bottom supporting said article and having side walls substantially perpendicular to said bottom, a first and a second one of said side walls forming a second corner;

a cover for said base; and a fixing element sandwiched between said article and said bottom of said base, and bent around said first corner of said article and around said second corner of said base so as to urge said article against said first and said second side walls of said base.

2. The combination according to claim 1, wherein said article comprises an item selected from the group comprising (a) a stack of sheets and (b) a pouch enclosing a stack of sheets.

3. The combination according to claim 1, wherein the container has a cuboidal shape.

4. The combination according to claim 1, wherein said fixing element has a first tape portion for being sandwiched between said article and said bottom of said base.

5. The combination according to claim 4, wherein said first tape portion has a thickness between 0.02 mm and 0.4 mm and comprises a plastic.

6. The combination according to claim 1, wherein said fixing element has a second tape portion for bending around said first corner of said article.

7. The combination according to claim 6, wherein said second tape portion is for bending manually around said first corner of said article.

* * * * *